US010047703B1

(12) United States Patent
Lee

(10) Patent No.: US 10,047,703 B1
(45) Date of Patent: Aug. 14, 2018

(54) VEHICLE EGR COOLER

(71) Applicants: Hyundai Motor Company, Seoul (KR); Kia Motors Corporation, Seoul (KR)

(72) Inventor: Jae Jin Lee, Anyang-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 15/719,310

(22) Filed: Sep. 28, 2017

(30) Foreign Application Priority Data

Apr. 10, 2017 (KR) ..... 10-2017-0045841

(51) Int. Cl.

| | |
|---|---|
| ***F02M 26/00*** | (2016.01) |
| ***F02M 26/29*** | (2016.01) |
| ***F28F 1/40*** | (2006.01) |
| ***F28F 27/02*** | (2006.01) |
| ***F02M 26/30*** | (2016.01) |

(52) U.S. Cl.
CPC ..... *F02M 26/29* (2016.02); *F02M 26/30* (2016.02); *F28F 1/40* (2013.01); *F28F 27/02* (2013.01)

(58) Field of Classification Search
CPC ..... F02M 26/29; F02M 26/30; F02M 26/32; F02M 26/33; F02M 26/35; F28F 1/40; F28F 27/02
USPC ..... 123/568.12
See application file for complete search history.

(56) References Cited

U.S. PATENT DOCUMENTS

| | | | | |
|---|---|---|---|---|
| 6,932,063 | B1 * | 8/2005 | Hu | F02D 13/0223 123/568.14 |
| 7,581,533 | B1 * | 9/2009 | Moran | F02M 26/26 123/568.12 |
| 8,967,126 | B2 * | 3/2015 | Vassallo | F01P 3/20 123/41.31 |
| 9,121,316 | B2 * | 9/2015 | Gerges | F01N 5/02 |
| 9,353,670 | B2 * | 5/2016 | Vassallo | F01P 3/20 |
| 9,664,087 | B2 * | 5/2017 | Sloss | F01N 5/02 |
| 2002/0152983 | A1 * | 10/2002 | Muth | F01L 7/029 123/190.1 |
| 2005/0056263 | A1 * | 3/2005 | Kennedy | F02B 29/0418 123/568.12 |
| 2005/0188965 | A1 * | 9/2005 | Usui | F28D 15/0266 123/568.12 |
| 2007/0017489 | A1 * | 1/2007 | Kuroki | F02M 26/25 123/568.12 |
| 2007/0267000 | A1 * | 11/2007 | Raduenz | F28D 9/0056 123/568.12 |

(Continued)

FOREIGN PATENT DOCUMENTS

KR 10-2007-0021440 A 2/2007

*Primary Examiner* — Thomas Moulis
(74) *Attorney, Agent, or Firm* — Morgan, Lewis & Bockius LLP

(57) ABSTRACT

A vehicle EGR cooler may include a housing provided wherein coolant flows therein, a gas tube into which exhaust gas flows through the housing, cooling fins disposed in the gas tube, a variable valve, a portion of which is fixed to one side of the housing, the variable valve having a length varied in a width direction of the cooling fins depending on a temperature of a coolant, and an auxiliary cooling fin provided at one side of the housing to be connected to the variable valve, the auxiliary cooling fin being inserted into the gas tube to be formed between the cooling fins, the auxiliary cooling fin coming into contact with or being away from the cooling fins while moving according to a variation in length of the variable valve, varying a radiation area for the exhaust gas.

11 Claims, 6 Drawing Sheets

(56) References Cited

U.S. PATENT DOCUMENTS

| | | | | |
|---|---|---|---|---|
| 2007/0289581 | A1* | 12/2007 | Nakamura | F28D 9/0025 123/568.12 |
| 2008/0314569 | A1* | 12/2008 | Yamazaki | F02M 37/0029 165/153 |
| 2009/0025915 | A1* | 1/2009 | Qvist | F28D 7/1653 165/149 |
| 2009/0044525 | A1* | 2/2009 | Husges | F02M 26/26 60/321 |
| 2009/0055083 | A1* | 2/2009 | Sasaki | F02D 35/024 701/104 |
| 2014/0150758 | A1* | 6/2014 | Zurlo | F02M 26/50 123/568.12 |
| 2015/0292820 | A1* | 10/2015 | Katoh | F25B 39/04 165/140 |
| 2017/0145948 | A1* | 5/2017 | Chu | F02M 26/14 |
| 2017/0152815 | A1* | 6/2017 | Peters | F02M 26/29 |
| 2017/0153071 | A1* | 6/2017 | Bravo Rodriguez | F28D 7/1684 |
| 2017/0298874 | A1* | 10/2017 | Kuske | F02M 26/24 |
| 2017/0335740 | A1* | 11/2017 | Dries | F01N 5/02 |
| 2017/0362988 | A1* | 12/2017 | Matsuura | F01N 5/02 |

* cited by examiner

VEHICLE EGR COOLER

CROSS-REFERENCE(S) TO RELATED APPLICATIONS

The present application claims priority to Korean Patent Application No. 10-2017-0045841 filed on Apr. 10, 2017, the entire contents of which is incorporated herein for all purposes by this reference.

BACKGROUND OF THE INVENTION

Field of the Invention

The present invention relates to a vehicle exhaust gas recirculation cooler configured for preventing performance degradation due to fouling.

Description of Related Art

Typically, an Exhaust Gas Recirculation (EGR) system is used to reduce nitrogen oxides ($NO_x$) included in exhaust gas emitted from an engine of a vehicle.

The EGR system resupplies a portion of the exhaust gas back to the engine to lower a temperature in a combustion chamber, and thus includes an EGR cooler to cool high-temperature exhaust gas before it is supplied to the engine.

A conventional EGR cooler includes a heat exchange fin having a structure in which fins are inserted into plate-type gas tubes. However, there is a problem in that the flow of the exhaust gas is interrupted due to fouling caused by exhaust soot accumulated in the gas tubes and the fins.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a vehicle EGR cooler configured for increasing a radiation area for an exhaust gas by decreasing a pitch of cooling fins when an engine is hot, and for preventing fouling by increasing the pitch of the cooling fins and removing soot accumulated on the cooling fins when the engine is cold.

In accordance with an aspect of the present invention, a vehicle EGR cooler includes a housing provided wherein a coolant flows therein, a gas tube into which exhaust gas flows through the housing, cooling fins disposed in the gas tube, a variable valve, wherein a portion of which is fixed to one side of the housing, the variable valve having a length varied in a width direction of the cooling fins depending on a temperature of the coolant, and an auxiliary cooling fin disposed at one side of the housing to be connected to the variable valve, wherein the auxiliary cooling fin is inserted into the gas tube to be disposed between the cooling fins, and the auxiliary cooling fin comes into contact with or moves away from the cooling fins according to a variation in length of the variable valve, varying a radiation area for the exhaust gas.

The length of the variable valve may be varied wherein the auxiliary cooling fin moves to come into contact with the cooling fins as the temperature of the coolant is low, whereas the auxiliary cooling fin moves to a position away from the cooling fins as the temperature of the coolant is high.

The auxiliary cooling fin may be formed wherein its upper or lower portion is in contact with the gas tube or the cooling fins.

The one side of the housing may be a position to which the exhaust gas is discharged from the gas tube.

A portion of the auxiliary cooling fin inserted into the gas tube may have a length which is less than half that of the gas tube.

The variable valve may include a fixed portion configured to pass through the housing while one side thereof exchanges heat with the coolant, and a variable portion protruding perpendicularly from the other side of the fixed portion, wherein the variable portion is longitudinally tensioned or compressed according to a temperature of the fixed portion.

The vehicle EGR cooler may further include a connector configured to connect the variable portion of the variable valve and the auxiliary cooling fin, and to move according to a variation in length of the variable portion of the variable valve.

The gas tube and the auxiliary cooling fin may be paired wherein the housing is provided with a plurality of paired gas tubes and auxiliary cooling fins, the variable valve may be provided as a single component, and the connector may extend vertically wherein the variable portion of the variable valve is coupled to one side of the connector and a plurality of auxiliary cooling fins are coupled to the other side of the connector.

The auxiliary cooling fin may include a plurality of coupling portions coupled to the connector extending along points facing upper and lower portions of the gas tube, and a plurality of heat exchange portions connecting the coupling portions and extending toward the cooling fins to be inserted between the cooling fins.

The heat exchange portions of the auxiliary cooling fin may include the same material as the cooling fins.

The fixed portion of the variable valve may include a heat conductive material, and the variable portion may be provided as a bimetallic or wax-type valve.

As apparent from the above description, since the radiation area for the exhaust gas is increased by decreasing the pitch of the cooling fins when the engine is hot in the vehicle EGR cooler having the above-mentioned structure, the performance of the EGR cooler can be enhanced to be maximized.

In addition, soot is actively accumulated when the engine is cold, in which case it is possible to remove the accumulated soot by moving the auxiliary cooling fin between the cooling fins, and to prevent fouling due to the accumulation of soot.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
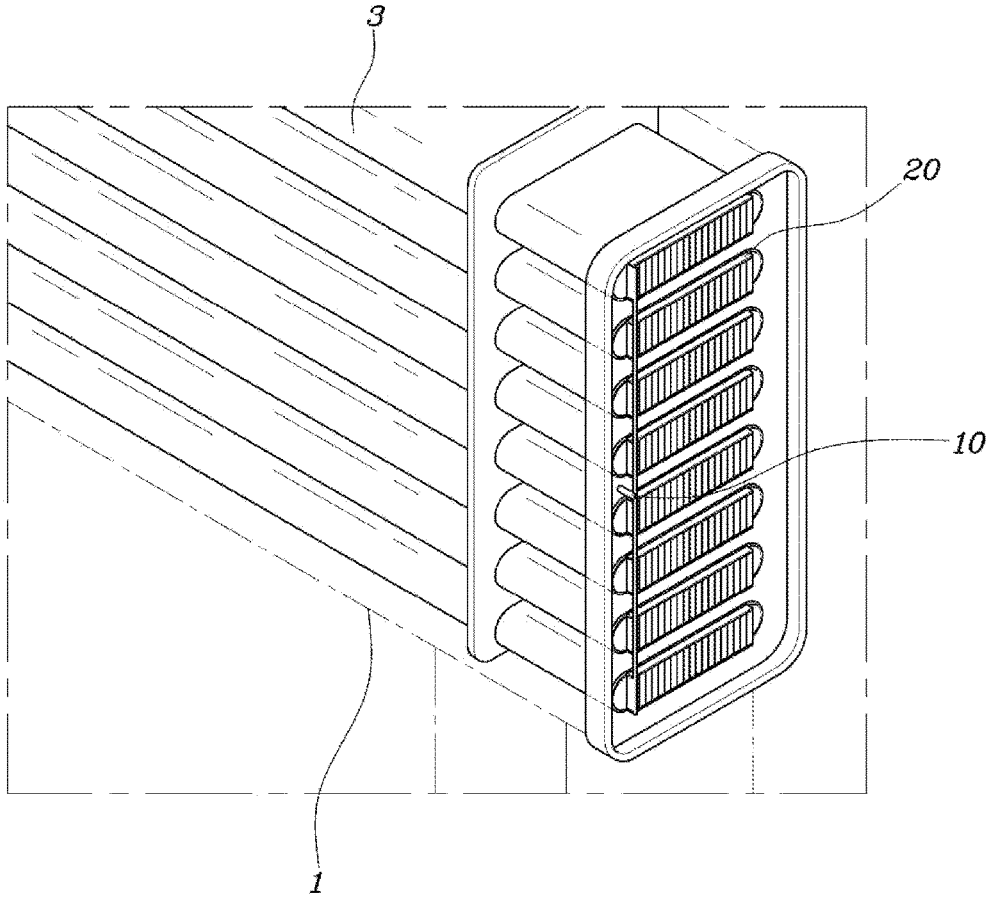
FIG. 1 is a perspective view illustrating a vehicle EGR cooler according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

A vehicle EGR cooler according to an exemplary embodiments of the present invention will be described below with reference to the accompanying drawings.

Figure 2:
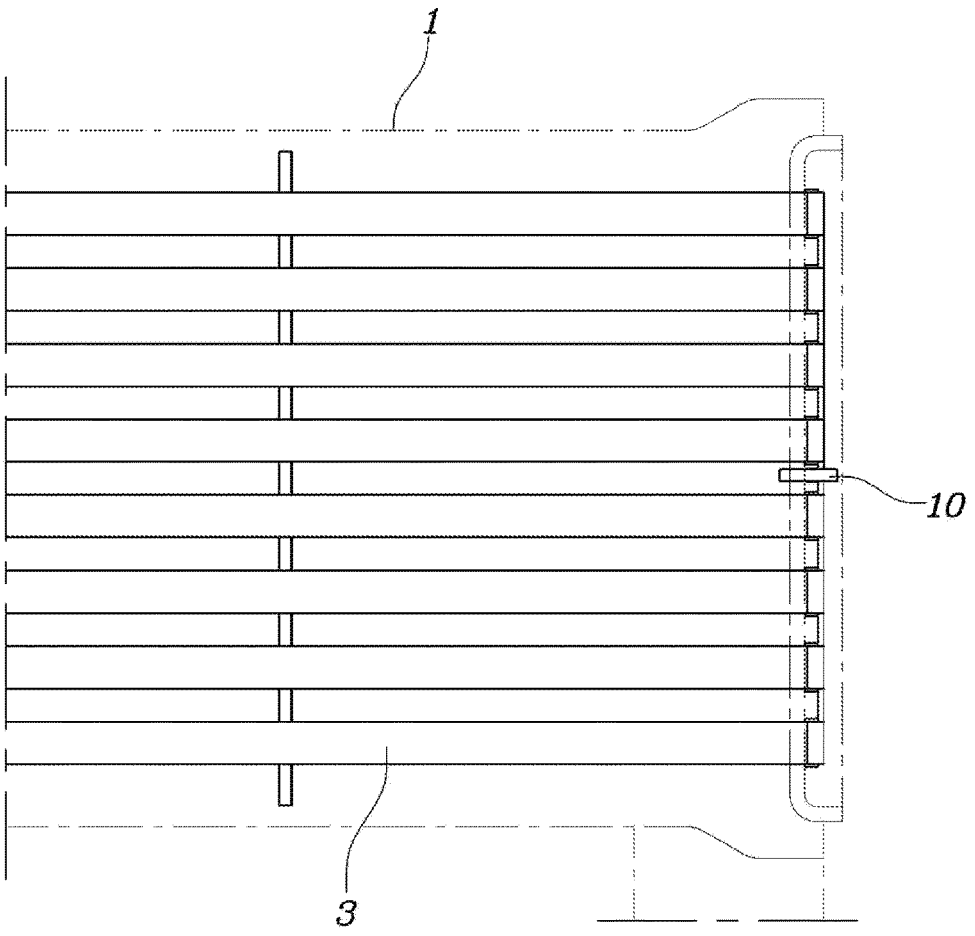
FIG. 2 is a lateral cross-sectional view of the vehicle EGR cooler according to the exemplary embodiment of the present invention.
Figure 3:
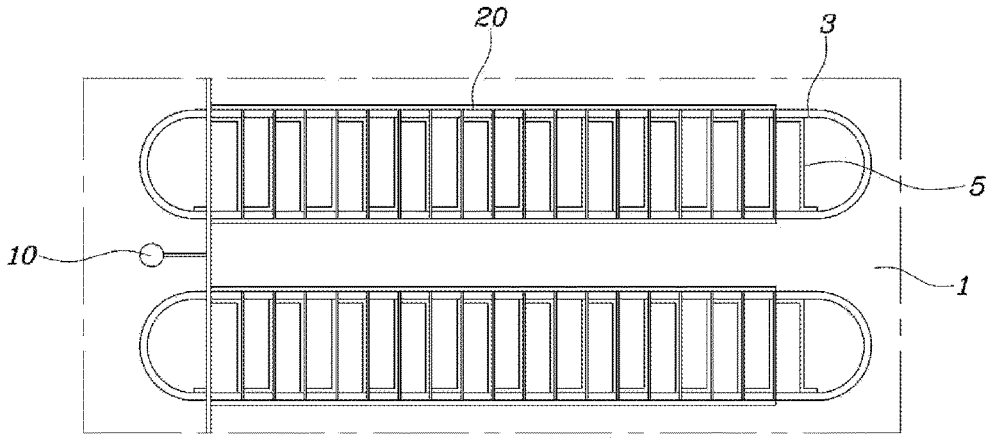
FIG. 3 and FIG. 4 are views illustrating movement of auxiliary cooling fins by operation of a variable valve according to the exemplary embodiment of the present invention.
Figure 4:
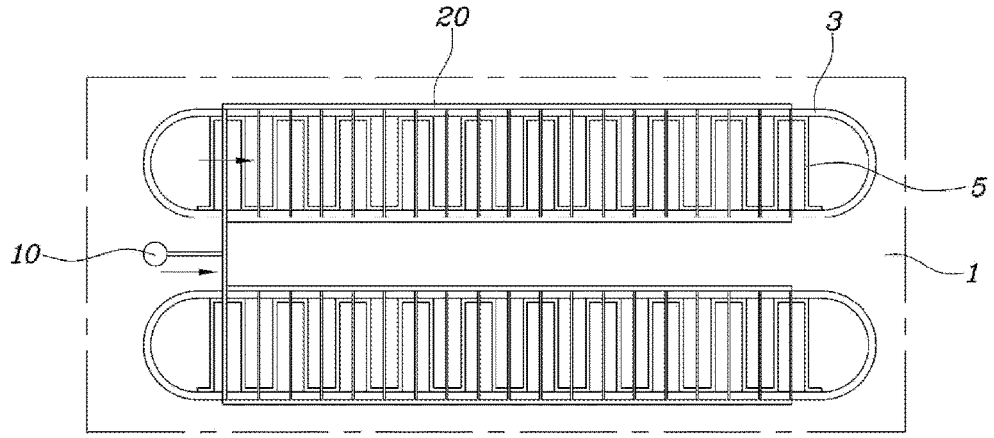

FIG. 1 is a perspective view illustrating a vehicle EGR cooler according to an exemplary embodiment of the present invention. FIG. 2 is a lateral cross-sectional view of the vehicle EGR cooler according to the exemplary embodiment of the present invention. FIG. 3 and FIG. 4 are views illustrating movement of auxiliary cooling fins by operation of a variable valve according to the exemplary embodiment of the present invention.

Referring to FIG. 1, FIG. 2, FIG. 3, and FIG. 4, the vehicle EGR cooler according to the exemplary embodiment of the present invention may include a housing 1 configured wherein a coolant flows therein, a gas tube 3 into which exhaust gas flows through the housing 1, cooling fins 5 disposed in the gas tube 3, a variable valve 10 wherein a portion of which is fixed to one side of the housing 1 and which has a length varied in the width direction of the cooling fins 5 depending on the temperature of the coolant, and an auxiliary cooling fin 20 that is provided at one side of the housing 1 to be connected to the variable valve 10, wherein the auxiliary cooling fin 20 is inserted into the gas tube 3 and is formed between the cooling fins 5 and comes into contact with or is away from the cooling fins 5 while moving according to the variation in length of the variable valve 10 to vary a radiation area for the exhaust gas.

In the vehicle EGR cooler according to the exemplary embodiment of the present invention, the housing 1 includes a chamber defined therein wherein coolant may be introduced into and discharged from the chamber.

The housing 1 is configured to pass the gas tube 3 therethrough, and the gas tube 3 is configured wherein the exhaust gas emitted from an engine is introduced thereinto and flows therein. Therefore, the exhaust gas flowing into the gas tube 3 is cooled by exchanging heat with the coolant flowing outside the gas tube 3.

Since the gas tube 3 is provided therein with the cooling fins 5 having a square wave shape in a widthwise cross-section, as illustrated in FIG. 3, it is possible to increase a radiation area for heat exchange with the exhaust gas flowing into the gas tube 3. Thus, it is possible to maximize the cooling performance of the vehicle EGR cooler. Here, the cooling fins 5 may have a widthwise cross-sectional shape in which a 'U'-shaped fin is repeatedly inverted while extending.

Meanwhile, the vehicle EGR cooler according to the exemplary embodiment of the present invention includes the auxiliary cooling fin 20 that is inserted into the gas tube 3 and varies a radiation area for the exhaust gas while moving to come into contact with or be away from the cooling fins 5. To the present end, the vehicle EGR cooler includes the variable valve 10 that is connected to the auxiliary cooling fin 20 at one side of the housing 1 and has a length varied depending on the temperature of coolant.

Here, the variable valve 10 includes a material to allow its length to be variable depending on the temperature of the coolant, and thus the auxiliary cooling fin 20 connected to the variable valve 10 is movable in the width direction in the state in which it is inserted into the cooling fins 5.

Accordingly, the widthwise cross-section pitch of the cooling fins 5 may be variable since the auxiliary cooling fin 20 moves in the state in which it is inserted into the cooling fins 5. Therefore, it is possible to vary the radiation area for the exhaust gas.

In addition, since soot accumulated on the cooling fins 5 is removable while the auxiliary cooling fin 20 moves in the width direction in the state in which it is inserted into the cooling fins 5, it is possible to prevent fouling due to the accumulation of soot.

In the vehicle EGR cooler according to the exemplary embodiment of the present invention, the length of the variable valve 10 may be variable wherein the auxiliary cooling fin 20 moves to come into contact with the cooling fins 5 as the temperature of coolant is low, whereas the auxiliary cooling fin 20 moves to a position away from the cooling fins 5 as the temperature of coolant is high.

In general, the accumulation of soot may tend to occur in a state in which the temperatures of the coolant and the exhaust gas are low when the engine is cold. Accordingly, to reduce the occurrence of soot as much as possible when the temperature of coolant is low, the auxiliary cooling fin 20 comes into contact with the cooling fins 5 to reduce the radiation area for the exhaust gas, as illustrated in FIG. 3.

That is, when the engine is cold, exhaust gas exchanges heat with the cooling fins 5 or the auxiliary cooling fin 20 while flowing into the gas tube 3 to reduce a possibility of occurrence of soot. Thus, since the accumulation of soot is reduced, it is possible to prevent the fouling of the EGR cooler.

On the contrary, since there is a low possibility of occurrence of soot when the engine is hot compared to when the engine is cold, it is preferable to enhance the cooling performance of the EGR cooler to the maximum.

Accordingly, when the temperature of coolant is high, the length of the variable valve 10 is preferably increased wherein the auxiliary cooling fin 20 moves to a position away from the cooling fins 5. FIG. 4 illustrates a state in which the length of the variable valve 10 is longest.

That is, when the length of the variable is short, it is preferable to design the variable valve 10 wherein the auxiliary cooling fin 20 is located at a position in which it comes into contact with the cooling fins 5. On the other hand, when the length of the variable is longest, it is preferable to design the variable valve 10 wherein the auxiliary cooling fin 20 is located at an intermediate position in a region surrounded by the cooling fins 5. Accordingly, the auxiliary cooling fin 20 is configured to be movable by a quarter of the widthwise pitch of the cooling fins 5 by the variable valve 10.

Accordingly, since the auxiliary cooling fin 20 moves to be positioned between the cooling fins 5 when the engine is hot, it is possible to increase a radiation area for heat exchange between the exhaust gas flowing into the gas tube 3, the cooling fins 5, and the auxiliary cooling fin 20. Thus, it is possible to maximize the cooling performance of the EGR cooler.

Here, the auxiliary cooling fin 20 may be formed wherein its upper or lower portion is in contact with the gas tube 3 or the cooling fins 5.

That is, it is necessary to conduct heat from coolant to use the auxiliary cooling fin 20 for cooling exhaust gas. Accordingly, it is possible to perform a function of cooling exhaust gas by designing the auxiliary cooling fin 20 wherein the upper or lower portion is in contact with the gas tube 3 or the cooling fins 5.

Meanwhile, the present invention is characterized in that the one side of the housing 1 is a position in which exhaust gas is discharged from the gas tube 3. That is, exhaust gas is introduced into the other side of the gas tube 3 and is then discharged to one side thereof with respect to the housing 1.

Here, the temperatures of the exhaust gas and the coolant at one side of the gas tube 3 as the discharge position of exhaust gas are relatively lower than those at the other side of the gas tube 3. The reason is because exhaust gas is cooled while flowing into the gas tube 3.

Accordingly, since there is a high possibility that soot is accumulated on one side of the cooling fins 5 disposed in the gas tube 3, rather than the other side thereof, the auxiliary cooling fin 20 is applied to the one side of the cooling fins 5. Thus, it is possible to remove the soot accumulated on the cooling fins 5 and also to reduce the accumulation of soot itself by minimizing the radiation area for the exhaust gas when the engine is cold.

Considering the present situation, the cooling fins 5 may be designed wherein the widthwise cross-section pitch thereof becomes long as the cooling fins 5 are close to one side of the housing 1. That is, it is possible to improve the cooling performance by shortening the widthwise pitch of the cooling fins 5 at the other side thereof in which the soot is less accumulated.

In addition, the present invention is characterized in that the portion of the auxiliary cooling fin 20 inserted into the gas tube 3 has a length less than half that of the gas tube 3.

Since the temperatures of the coolant and the exhaust gas are relatively high at the other side of the gas tube 3 into which exhaust gas is introduced, there is a low possibility that soot is accumulated on the cooling fins 5. Thus, it is unnecessary to intentionally insert the auxiliary cooling fin 20 into the whole gas tube 3.

Therefore, the length of the auxiliary cooling fin 20 may be less than half the length of the gas tube 3 to reduce the cost and time required to manufacture the auxiliary cooling fin 20.

In more detail, the variable valve 10 according to the exemplary embodiment of the present invention may include a fixed portion 13 that is configured to pass through the housing 1 while one side thereof exchanges heat with the coolant, and a variable portion 15 that protrudes perpendicularly from the other side of the fixed portion 13 and is longitudinally tensioned or compressed according to the temperature of the fixed portion 13.

Here, the fixed portion 13 of the variable valve 10 may include a heat conductive material, and the variable portion 15 may be provided as a bimetallic or wax-type valve.

Figure 5:
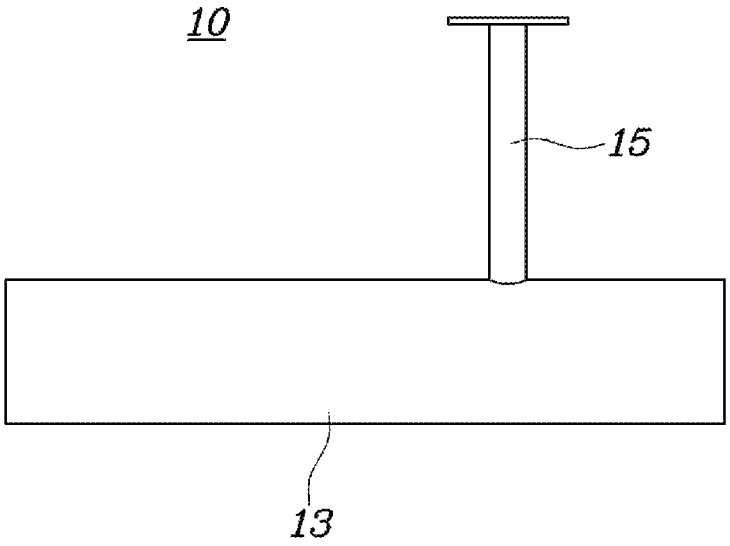
FIG. 5 is a view illustrating the variable valve according to the exemplary embodiment of the present invention.

FIG. 5 is a view illustrating the variable valve according to the exemplary embodiment of the present invention. Referring to FIG. 2 and FIG. 5, the fixed portion 13 including the heat conductive material is configured to pass through the housing 1 and is defined as the temperature of the coolant. The variable portion 15 formed perpendicularly from the fixed portion 13 is provided as a bimetallic or wax-type valve and has a variable length depending on the temperature of the fixed portion 13.

Accordingly, since the variable valve 10 formed at one side of the housing 1 has a length varied depending on the temperature of the coolant, it is possible to vary the movement of the auxiliary cooling fin 20.

The vehicle EGR cooler according to the exemplary embodiment of the present invention may further include a connector 30 that connects the variable portion 13 of the variable valve 10 and the auxiliary cooling fin 20, and moves according to the variation in length of the variable portion 13 of the variable valve 10.

Here, the gas tube 3 and the auxiliary cooling fin 20 are paired, the housing 1 is provided with a plurality of paired gas tubes and auxiliary cooling fins, and the variable valve 10 is provided as a single component. The connector 30 extends vertically wherein the variable portion 15 of the variable valve 10 may be coupled to one side of the connector 30 and a plurality of auxiliary cooling fins 20 may be coupled to the other side of the connector 30.

Figure 6:
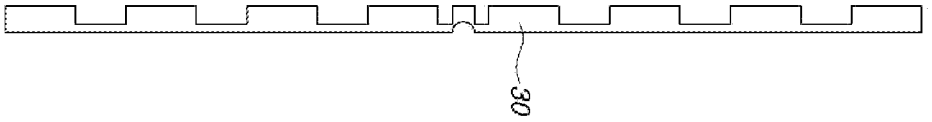
FIG. 6 is a view illustrating a connector according to the exemplary embodiment of the present invention.

FIG. 6 is a view illustrating the connector according to the exemplary embodiment of the present invention. Referring to FIG. 1 to FIG. 6, the gas tube 3 includes a plurality of gas tubes disposed in the housing 1 to maximize the cooling performance of the EGR cooler, and thus the number of auxiliary cooling fins paired with the gas tubes 3 are increased.

In the present case, a plurality of variable valves may be adopted in an exemplary embodiment of the present invention, but will induce an increase in costs. Therefore, the variable valve 10 is provided as a single component, and the connector 30 extending vertically is configured to connect the variable valve 10 to the auxiliary cooling fins 20. Consequently, it is possible to vary the movement of the plurality of auxiliary cooling fins 20 even by the single variable valve 10.

Meanwhile, each of the auxiliary cooling fins 20 according to the exemplary embodiment of the present invention may include a plurality of coupling portions 23 that are coupled to the connector 30 to extend along points facing upper and lower portions of an associated one of the gas tubes 3, and a plurality of heat exchange portions 25 that connects the coupling portions 23 and extends toward the associated ones of the cooling fins 5 to be inserted between the cooling fins 5.

Figure 7:
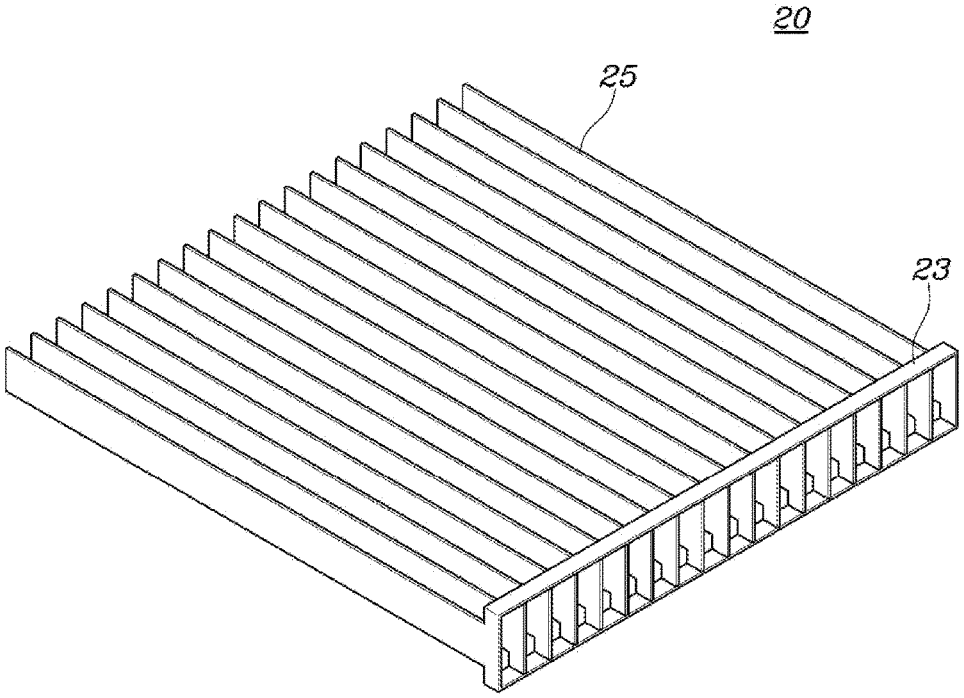
FIG. 7 is a perspective view illustrating one auxiliary cooling fin according to the exemplary embodiment of the present invention.

FIG. 7 is a perspective view illustrating one of the auxiliary cooling fins 20 according to the exemplary embodiment of the present invention. Referring to FIG. 3, FIG. 4, and FIG. 7, the auxiliary cooling fin 20 according to the exemplary embodiment of the present invention includes the plurality of respective heat exchange portions 25 inserted between the cooling fins 5. Therefore, it is possible to effectively remove soot accumulated on the cooling fins 5 according to the movement of the auxiliary cooling fin 20 and to maximize the cooling performance of the EGR cooler by maximally enlarging the radiation area for the exhaust gas when the engine is hot.

Here, the heat exchange portions 25 of the auxiliary cooling fin 20 may include the same material as the cooling fins 5. That is, the heat exchange portions 25 may include a high heat conductive material or the same material as the cooling fins 5 to cool exhaust gas as in the cooling fins 5.

According to the vehicle EGR cooler having the above-mentioned structure, since the radiation area for the exhaust gas is increased by decreasing the pitch of the cooling fins when the engine is hot, the performance of the EGR cooler can be enhanced to the maximum.

In addition, soot is actively accumulated when the engine is cold, in which case it is possible to remove the accumulated soot by moving the auxiliary cooling fin between the cooling fins and to prevent fouling due to the accumulation of soot.

For convenience in explanation and accurate definition in the appended claims, the terms "upper", "lower", "internal", "outer", "up", "down", "upwards", "downwards", "front", "rear", "back", "inside", "outside", "inwardly", "outwardly", "internal", "external", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A vehicle EGR cooler comprising:

a housing in which a coolant flows;

a gas tube into which exhaust gas flows through the housing;

cooling fins disposed in the gas tube;

a variable valve, a portion of which is fixed to a first side of the housing, the variable valve having a length varied in a width direction of the cooling fins depending on a temperature of the coolant; and an auxiliary cooling fin provided at the first side of the housing to be connected to the variable valve, the auxiliary cooling fin being inserted into the gas tube to be formed between the cooling fins, the auxiliary cooling fin contacting with or being away from the cooling fins while moving according to a variation in length of the variable valve, varying a radiation area for exhaust gas.

2. The vehicle EGR cooler according to claim 1, wherein the length of the variable valve is varied such that the auxiliary cooling fin moves to contact with the cooling fins as the temperature of the coolant is lower than a predetermined value, and wherein the auxiliary cooling fin moves toward a position away from the cooling fins as the temperature of the coolant is higher than the predetermined value.

3. The vehicle EGR cooler according to claim 1, wherein upper or lower portion of the auxiliary cooling fin is formed to be in contact with the gas tube or the cooling fins.

4. The vehicle EGR cooler according to claim 1, wherein the first side of the housing is a position in which the exhaust gas is discharged from the gas tube.

5. The vehicle EGR cooler according to claim 4, wherein a portion of the auxiliary cooling fin inserted into the gas tube has a length less than half that of the gas tube.

6. The vehicle EGR cooler according to claim 1, wherein the variable valve includes:

a fixed portion formed to pass through the housing while a first side thereof exchanges heat with the coolant; and a variable portion protruding perpendicularly from a second side of the fixed portion, the variable portion being longitudinally tensioned or compressed according to a temperature of the fixed portion.

7. The vehicle EGR cooler according to claim 6, further including a connector connecting the variable portion of the variable valve and the auxiliary cooling fin, and moving according to a variation in length of the variable portion of the variable valve.

8. The vehicle EGR cooler according to claim 7, wherein the gas tube and the auxiliary cooling fin are paired wherein the housing is provided with a plurality of paired gas tubes and auxiliary cooling fins;

the variable valve is provided as a single component; and the connector extends vertically and the variable portion of the variable valve is coupled to a first side of the connector and a plurality of auxiliary cooling fins is coupled to a second side of the connector.

9. The vehicle EGR cooler according to claim 7, wherein the auxiliary cooling fin includes:

a plurality of coupling portions coupled to the connector to extend along points facing upper and lower portions of the gas tube; and a plurality of heat exchange portions connecting the coupling portions and extending toward the cooling fins to be inserted between the cooling fins.

10. The vehicle EGR cooler according to claim 9, wherein the heat exchange portions of the auxiliary cooling fin include a same material as the cooling fins.

11. The vehicle EGR cooler according to claim 6, wherein the fixed portion of the variable valve includes a heat conductive material, and the variable portion is provided as a bimetallic or wax-type valve.

* * * * *